US005407645A

United States Patent [19]

Daeumer et al.

[11] Patent Number: 5,407,645

[45] Date of Patent: Apr. 18, 1995

[54] HYDROGEN STORAGE DEVICE FOR A PLASMA SWITCH

[75] Inventors: Wolfgang Daeumer; Dieter Gerlach, both of Berlin, Germany

[73] Assignee: Siemens Aktiengesellschaft, München, Germany

[21] Appl. No.: 102,400

[22] Filed: Aug. 5, 1993

Related U.S. Application Data

[63] Continuation of Ser. No. 904,973, Jun. 26, 1992, abandoned.

[30] Foreign Application Priority Data

Jun. 27, 1991 [EP] European Pat. Off. ..... 91250170

[51] Int. Cl.[6] ..... H01J 1/24; H01J 19/18

[52] U.S. Cl. ..... 422/166; 313/340; 313/547; 313/609

[58] Field of Search ..... 422/125, 166; 313/547, 313/340, 231.41, 609, 551; 315/111.21, 115

[56] References Cited

U.S. PATENT DOCUMENTS

| | | | |
|---|---|---|---|
| 2,883,576 | 4/1959 | Harries | 313/340 |
| 2,899,591 | 8/1959 | Stein | 313/340 |
| 2,919,373 | 12/1959 | Riley et al. | 313/340 |
| 3,005,924 | 10/1961 | Reilly et al. | 313/609 |
| 3,222,561 | 12/1965 | Reinhardt | 313/547 |
| 3,428,860 | 2/1969 | Mastrup | 313/547 |
| 4,431,018 | 2/1984 | Finnegan | 137/68.1 |
| 4,479,603 | 10/1984 | Finnegan | 228/155 |
| 4,604,752 | 8/1986 | Sequin et al. | 313/231.41 |
| 4,775,916 | 10/1988 | Kouzuchi et al. | 361/388 |

FOREIGN PATENT DOCUMENTS

| | | |
|---|---|---|
| 3721529 | 1/1989 | Germany . |
| WO89/00354 | 1/1989 | WIPO . |
| WO90/09673 | 8/1990 | WIPO . |

OTHER PUBLICATIONS

Advances in Electronics and Electron Physics, Academic Press, New York and London, vol. XIV, 1961, pp. 211–218.

*Primary Examiner*—Robert J. Warden
*Assistant Examiner*—Hien Tran
*Attorney, Agent, or Firm*—Kenyon & Kenyon

[57] ABSTRACT

A heated hydrogen storage device for a plasma switch includes a ring-shaped holder element having an inwardly directed, ring-shaped shoulder that forms an opening. The device also includes a first and a second metal disk, with the first metal disk having a cut-out portion. A heating element is arranged between the first and second metal disks and is insulated therefrom. The heating element forms a turned heating track and has one end contacting the second metal disk and a second end extending outside through the cut-out portion of the first metal disk. The first metal disk and the heating element are stacked one above the another and rests on the ring-shaped shoulder of the ring-shaped holder element. The second metal disk is connected to the holder element and it covers the opening of the holder element. The second metal disk also fixes the first metal disk and the heating element in position.

3 Claims, 3 Drawing Sheets

HYDROGEN STORAGE DEVICE FOR A PLASMA SWITCH

This is a continuation of application Ser. No. 07/904,973 filed Jun. 26, 1992, now abandoned.

BACKGROUND OF THE INVENTION

The invention relates generally to the field of vacuum electronics and more particularly to a hydrogen storage device for a plasma switch having a hydrogen atmosphere.

To control the interior gas pressure of a thyratron, a hydrogen storage device is typically used, which essentially includes a metal storage element and a heating element. Foils or sheets of metal such as barium, tantalum, zircon or titanium are used as storage elements ("Adv. Electronics and Electron Physics," Vol. XIV, 1961, pages 211–218). A hydrogen storage device normally used for thyratrons may include, for example, two circular titanium sheets and an insulated heating coil arranged therebetween. The inner end of the coil contacts one of the titanium sheets.

A hydrogen storage device is also required for another plasma switch developed recently, which has become known by the name "pseudo-spark switch" or "hollow electrode switch." A storage device used for these purposes is formed from a cylindrical element of titanium located in a nickel sleeve that is open at the ends, which in turn is surrounded by a heating coil. This storage device is located in a metal housing which prevents heat radiation, but which communicates with the remaining interior of the plasma switch via openings. The connectors of the heating coil extend through the housing wall to the outside in an insulated manner (see WO 89/00 354).

The present invention is directed to the problem of designing a hydrogen storage device that is easy to produce, test and install.

SUMMARY OF THE INVENTION

The present invention provides a heated hydrogen storage device for a plasma switch that includes a ring-shaped holder element having an inwardly directed, ring-shaped shoulder that forms an opening. The device also includes a first and a second metal disk, with the first metal disk having a cut-out portion. A heating element is arranged between the first and second metal disks and is insulated therefrom. The heating element forms a turned heating track and has one end contacting the second metal disk and a second end extending outside through the cut-out portion of the first metal disk. The first metal disk and the heating element are stacked one above the another and rest on the ring-shaped shoulder of the ring-shaped holder element. The second metal disk is connected to the holder element and it covers the opening of the holder element. The second metal disk also fixes the first metal disk and the heating element in position.

The use of a stable holder element for those elements of the above-described hydrogen storage device which are essential for its functioning results in an overall construction that is compact. Further, the ring-shaped holder element allows the hydrogen storage device as a whole to be handled in a simple manner. For example, a holder stirrup, via which the hydrogen storage device can be fixed in place inside the plasma switch, can be attached to the holder element. In this regard, the holder element simultaneously forms one connection of the heating element, while the other connection of the heating element is easily accessible through the cut-out in the first metal disk.

The heating element is advantageously adapted to the compact structure of the new hydrogen storage device by providing as the heating track a circular metal foil having alternating, parallel grooves which start at two opposing circumferential segments. To insulate the heating track between the two metal disks an insulation film or a thin insulation disk can be provided. The heating track, which may be formed from a molybdenum foil, for example, has a circuitous shape.

The above-described arrangement allows each of the two ends of the heating strip to form a contact in a very simple manner. One end of the strip can be directly connected by spot-welding to the second metal disk through a cut-out in the corresponding insulation film, while the other end, formed from an angled part of the metal foil, extends to the outside through a cut-out in the corresponding insulation film and the first metal disk, and can be connected thereto with a wire-shaped or strip-shaped connection element.

DETAILED DESCRIPTION

Figure 1:
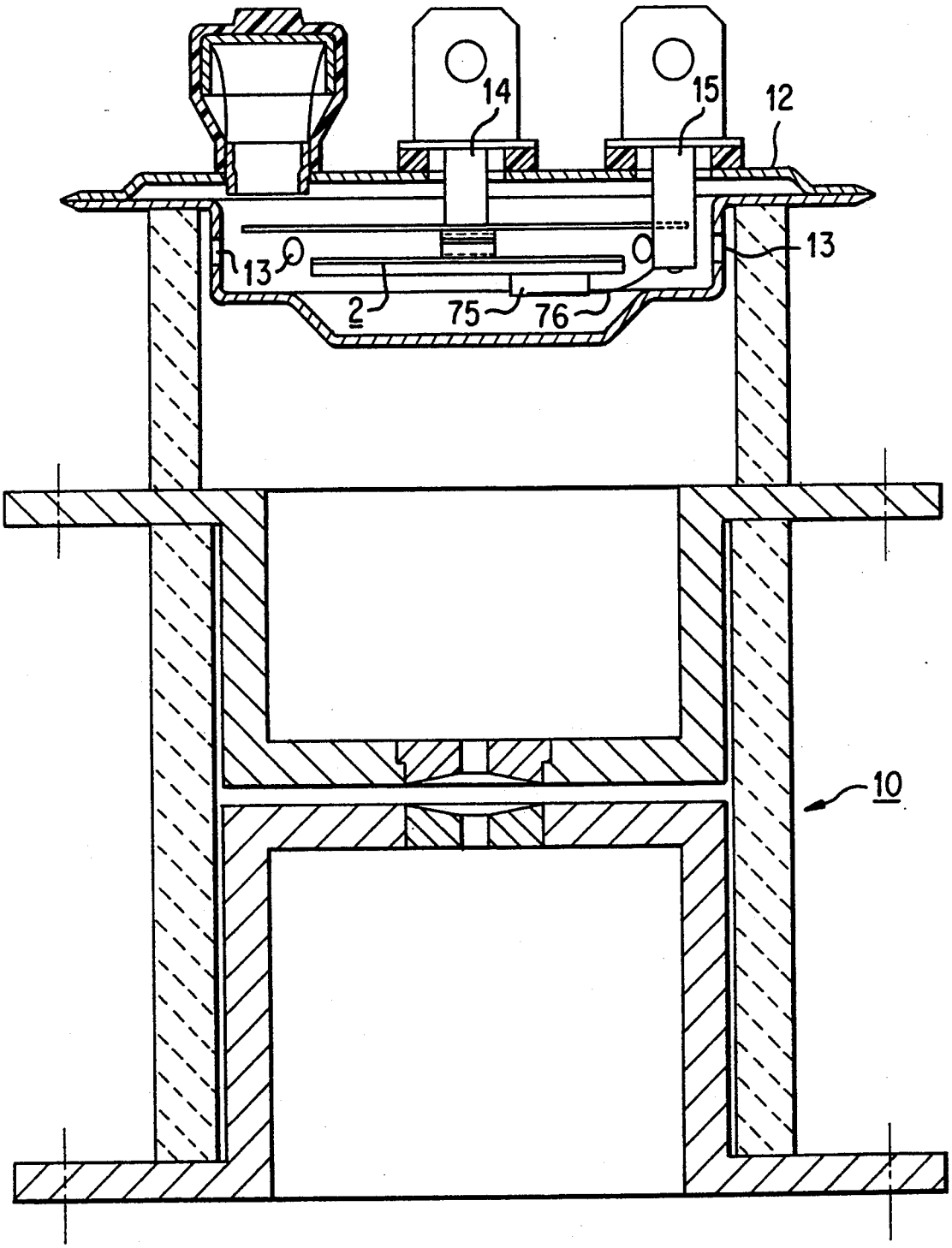
FIG. 1 is a schematic illustration of the hydrogen storage device within a plasma switch constructed according to the principles of the present invention.
Figure 2:
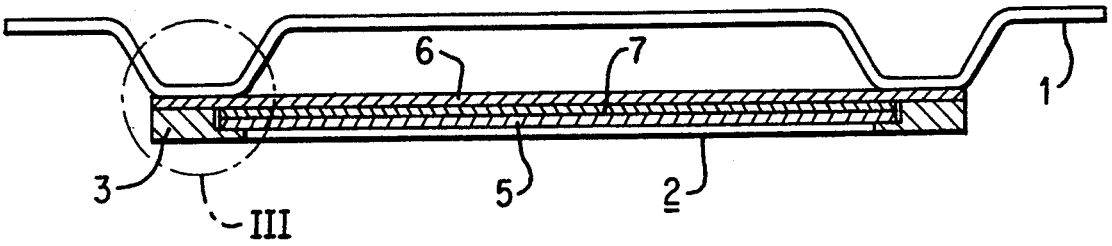
FIG. 2 is a cross-sectional view of the hydrogen storage device seen in FIG. 1.

FIG. 1 shows a hollow electrode switch 10, which corresponds to the switch disclosed in FIGS. 1 and 2 of WO 89/00354. In the upper region of the switch 10 a hydrogen storage device 2 is arranged in a metal housing 12. The metal housing 12 can communicate with the remaining interior portion of the plasma switch via openings 13. The two connectors 14 and 15 of the hydrogen storage device 2 extend to the outside through the housing wall in an insulated manner. At this location, the hydrogen storage device 2 is mechanically fixed to the connection 14.

Figure 3:
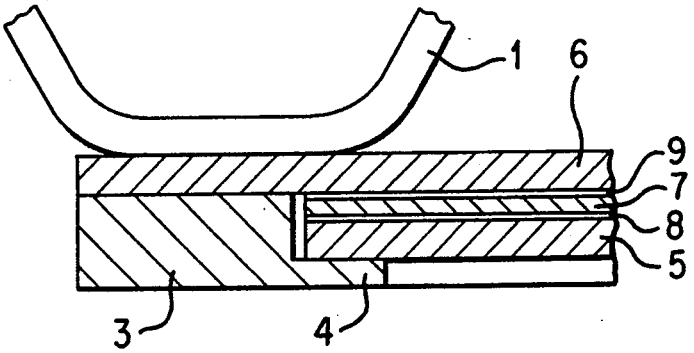
FIG. 3 is an enlarged detail of the portion of FIG. 2 enclosed by the circle.

According to FIG. 2, a stirrup-shaped holder element 1 is provided. The holder element 1 is attached to the hydrogen storage device 2, which is formed in the shape of a disk. The hydrogen storage device 2 includes a holder element 3, which forms a flat ring and is designed to have a pocket open from the top to the bottom. As seen in FIG. 3, a ring-shaped shoulder or flange 4 disposed on the inner circumferential surface of the holder 3 serves for this purpose. Resting on the shoulder 4, listed in order from bottom to top, is a first metal disk 5, an insulation film 8, a heating element 7, a second insulation film 9 and a second metal disk 6. The metal disk 6 covers the open pocket of the holder element 3 and, therefore, it also rests on the ring-shaped edge of the holder element 3, to which it is spot-welded. Instead of a single metal disk 5 or 6, two or more metal foils may be provided for each disk to obtain a larger exit surface.

Figure 4:
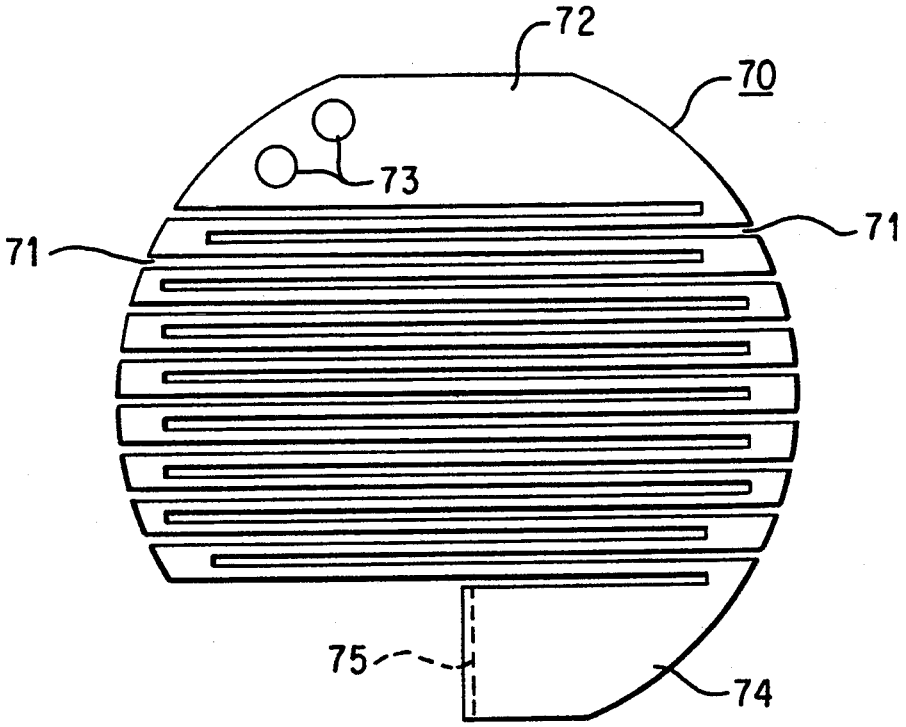
FIG. 4 is a top view of the heating element.
Figure 5:
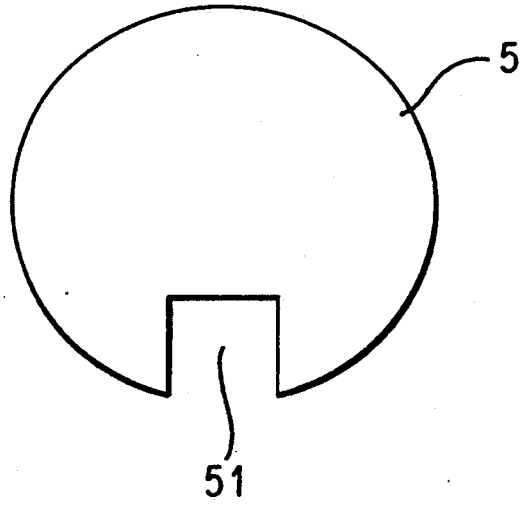
FIG. 5 is top view of the second metal disk having a cut-out portion.

The two metal disks 5 and 6 may be made from titanium, for example. Mica sheets or thin ceramic sheets may be used, for example, for the insulation films 8 and 9. The heating element is formed from a foil 70 of molybdenum. This foil is structured as a circuitously-shaped heating track, as shown in FIG. 4. To form the track, alternating, parallel grooves 71 are provided that start at two opposite segments of the circumference. The grooves 71 may be produced by erosion or etching, for example. Tab 72 and 74 are provided on both sides of the grooves 71. The tab 72 contacts the second metal disk 6 through a cut-out in the insulation film 9. This contact may be formed, for example, by using two weld points 73. The tab 74 is angled downward at half its length, so that a connecting lug 75 is formed. As seen in FIGS. 1 and 5, this connecting lug 75 passes to the outside through cut-out in the insulation film 8 and cut-out 51 in the metal disk 5, and connects to the second heating connector 15 via a wire 76.

A hydrogen storage device designed as described above has a high degree of effectiveness, since the heating element, which is formed as a flat heating track, rests against the metal disks or metal foils 5 and 6 of titanium, niobium, vanadium or tantalum which emit hydrogen over a large area, via the insulation films. The hydrogen atoms can be emitted to the interior of the plasma switch in a free and unhindered manner.

What is claimed is:

1. A heated hydrogen storage device for a plasma switch comprising:

a) a flat, ring-shaped holder element including a ring-shaped flange projecting radially inward, said holder element having a frontal surface;

b) a first metal disk, said first metal disk being arranged on said flange of said ring-shaped holder element and having a cut-out;

c) a first insulating sheet arranged on said first metal disk;

d) a heating element, said heating element i) comprising a circular metal foil having alternating, parallel grooves, a first connection tab at a first end of the metal foil and angled from a surface of the metal foil, and a second connection tab at a second end of the metal foil, and ii) being arranged on said first insulating sheet such that said first connecting tab projects through said cut-out of said first metal disk;

e) a second insulating sheet arranged on said heating element; and f) a second metal disk, said second metal disk arranged on said second insulating film and connected with said second connecting tab of said heating element and connected with said frontal surface of said ring-shaped holder.

2. The storage device of claim 1 wherein at least one of said first and second insulating sheets is a mica sheet.

3. The storage device of claim 1 wherein at least one of said first and second insulating sheets is a ceramic sheet.

* * * * *